United States Patent [19]

Takayama

[11] Patent Number: 4,703,743

[45] Date of Patent: Nov. 3, 1987

[54] FUEL SUPPLY APPARATUS WITH FUEL ATOMIZER

[75] Inventor: Teruo Takayama, Katsuta, Japan

[73] Assignee: Hitachi, Ltd., Tokyo, Japan

[21] Appl. No.: 816,842

[22] Filed: Jan. 7, 1986

[30] Foreign Application Priority Data

Jan. 25, 1985 [JP] Japan ..... 60-13019

[51] Int. Cl.[4] ..... F02M 29/00

[52] U.S. Cl. ..... 123/590; 123/478

[58] Field of Search ..... 123/590, 478; 261/DIG. 48

[56] References Cited

U.S. PATENT DOCUMENTS 4,105,004 8/1978 Asai et al. ..... 123/590

FOREIGN PATENT DOCUMENTS 2827322 1/1980 Fed. Rep. of Germany ..... 123/590
140415 12/1978 Japan ..... 123/590
140417 12/1978 Japan ..... 123/590
35185 3/1980 Japan ..... 123/590
50255 5/1981 Japan ..... 123/590

*Primary Examiner*—E. Rollins Cross
*Attorney, Agent, or Firm*—Antonelli, Terry & Wands

[57] ABSTRACT

A vibration-increasing block having a cylindrical vibrator affixed to a free end thereof is inserted into a suction passage through a lateral bore of an atomizer body of a fuel supply device for an internal combustion engine. A filler member is inserted into a space between the inner surface of the lateral bore and the outer surface of the vibration-increasing block after the vibration-increasing block has been inserted into the lateral bore. The filler member may be formed integrally or may be divided into a plurality of components. With the installation of the filler member into the space, fuel does not collect between the inner surface of the lateral bore and the outer surface of the vibration-increasing block, so that fuel does not flow along the wall of the atomizer body.

9 Claims, 7 Drawing Figures

FUEL SUPPLY APPARATUS WITH FUEL ATOMIZER

BACKGROUND OF THE INVENTION

1. Field of the Invention

The present invention relates to a fuel supply apparatus having a fuel atomizer and, more particularly, to a fuel supply apparatus employing a fuel atomizer for an internal combustion engine in an automobile, the fuel atomizer being adapted to atomize fuel through ultrasonic vibration.

2. Description of the Prior Art

A desired objective of a fuel supply apparatus employing a fuel atomizer for an internal combustion engine for use in an automobile is its ability to atomize fuel, mix the atomized fuel with air and supply a homogeneous gaseous mixture to the engine. This objective serves to improve engine output, minimize the fuel consumption and improve the operational characteristics and performance. However, no effective means for meeting these requirements in a fuel supply apparatus having the fuel atomizer for an internal combustion engine for use in a automobile has ever been practically implemented.

The previously employed fuel atomizing techniques for an automobile, are classified into one of two techniques. According to one technique, a carburetor is used as a basic element, and a fuel from fuel discharge port is applied to a vibrator, through which fuel is ultrasonically vibrated, so as to be atomized. According to the second technique, a fuel injection system is used as a basic element, and fuel from a fuel discharge port is atomized by ultrasonic vibration.

Atomizing fuel by ultrasonic vibration is very effective in that fuel can be momentarily atomized. However installing a fuel atomizer utilizing ultrasonic vibration is very difficult. A fuel atomizer utilizing ultrasonic vibration is described for example, in Japanese Patent Publication No. 48193/1980.

According to the description in this publication, a fuel atomizer is provided in the body of a fuel supply unit. A hollow, cylindrical vibrator and an ultrasonically vibrated vibration-increasing block supporting the cylindrical vibrator are inserted respectively through a lateral bore, which is provided in the body of the fuel supply unit. The lateral bore-insertable cross-sectional area of the cylindrical vibrator is larger than that of the vibration-increasing block.

Accordingly, after the cylindrical vibrator has been set in the body of the fuel supply unit, a clearance or space exists between the inner surface of the lateral bore and the outer surface of the vibration-increasing block, in which clearance fuel is collected. The collected fuel flows along the wall surface of the body of the fuel supply unit to be supplied to the engine. This causes a decrease in the fuel atomizing effect.

After the vibration-increasing block has been inserted into the body of the fuel supply unit through the lateral bore, installation of the cylindrical vibrator to the free end of the vibration-increasing block becomes very difficult.

SUMMARY OF THE INVENTION

An object of the present invention is to provide a fuel supply apparatus having a fuel atomizer wherein fuel atomization efficiency can be improved.

Another object of the present invention is to provide a fuel supply apparatus having a fuel atomizer wherein a fuel atomizer utilizing ultrasonic vibration can be installed easily.

A further object of the present invention is to provide a fuel supply apparatus employed a fuel atomizer wherein the flow of fuel along the wall of the atomizer body does not occur.

Still another object of the present invention is to provide a fuel supply apparatus having a fuel atomizer wherein a fuel does not run into the engine.

An additional object of the present invention is to provide a fuel supply apparatus having a fuel atomizer wherein the output level based on the atomization of fuel and fuel consumption can be improved.

The present invention provides a fuel supply apparatus having a fuel atomizer comprising a suction passage in the body of a fuel supply unit for an internal combustion engine. A lateral bore is provided in a side wall of the body of the fuel supply unit and an injector having a fuel discharge port is provided in the body of the fuel supply unit. A throttle valve is provided in the suction passage and a vibrator is formed cylindrically so that the axis of the vibrator extends toward the suction passage, and the vibrator is provided with an opening facing to the fuel discharge port. A vibration-increasing block is fixed to a free end the vibrator, the vibration-increasing block being inserted into the suction passage through the lateral bore toward the suction passage. The lateral bore-insertable cross-sectional area of the vibrator is larger than that of the vibration-increasing block. A space remains between the inner surface of the lateral bore and the outer surface of the vibration-increasing block after the vibration-increasing block has been inserted into the lateral bore. A filler member is inserted into this space and leaves a gap between the inner surface of the filler member and the outer surface of the vibration-increasing block that enables the vibration-increasing block to be vibrated therein.

The fuel supply apparatus with a fuel atomizer according to the present invention is capable of improving fuel atomization efficiency.

DETAILED DESCRIPTION OF THE PREFERRED EMBODIMENTS

An embodiment of a fuel supply apparatus having a fuel atomizer according to the present invention will now be described with reference to FIG. 1.

Figure 1:
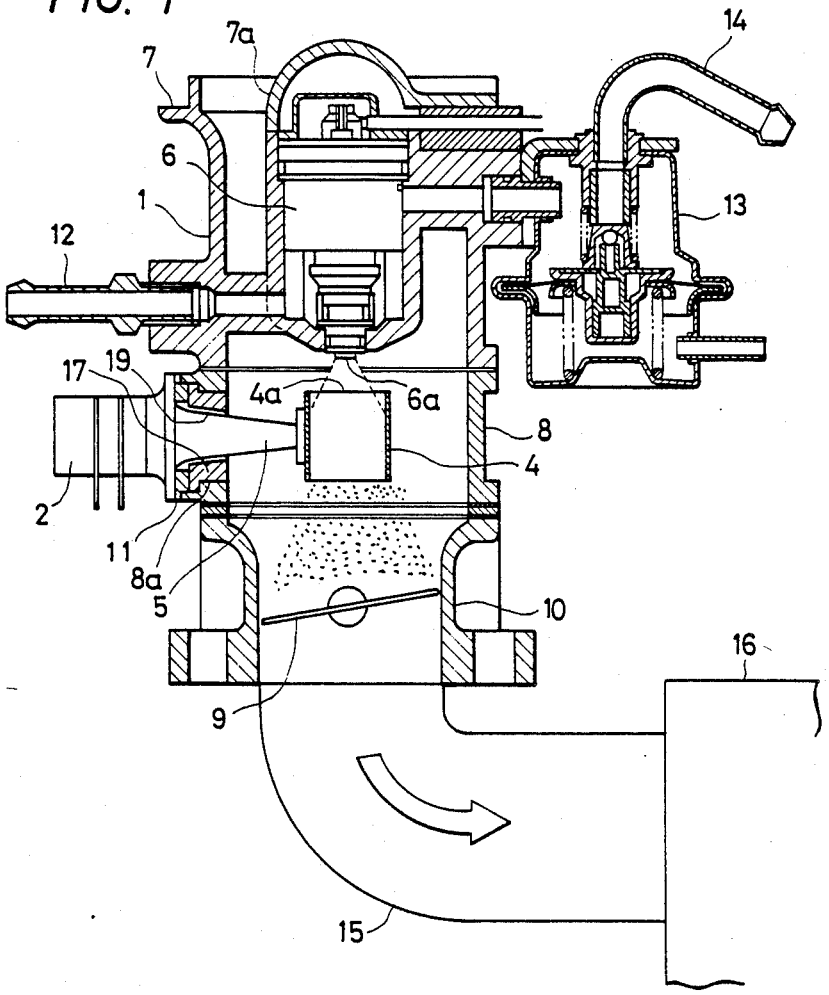
FIG. 1 is a longitudinal sectional view of one embodiment of the fuel supply apparatus having a fuel atomizer according to the present invention.

FIG. 1 is a longitudinal sectional view of the fuel supply apparatus having a fuel atomizer. Referring to the drawing, a body 1 of a fuel supply unit comprises an upper body 7 having an injector 6 in the substantially central portion thereof, and further comprises an atomizer body 8 and a throttle body 10.

The atomizer body 8 has a fuel atomizer 2 provided with a hollow, cylindrical vibrator 4 in the substantially central portion thereof. The throttle body 10 has a throttle valve 9 disposed in the substantially central portion thereof.

The cylindrical vibrator 4 has an end opening 4*a* facing to a fuel discharge port 6*a* of the injector 6, and is supported on an ultrasonically-driven vibration-increasing block 5. The cylindrical vibrator 4 is inserted into the atomizer body 8 through a lateral bore 8*a* in the atomizer body 8.

The projected shape of the cylindrical vibrator 4 as seen from the inner end is square. The lateral bore 8*a* is large enough to permit the passage of the cylindrical vibrator 4 therethrough.

The projected shape of the lateral bore 8*a* as seen from the inner surface the atomizer body 8 is substantially square. The projected shape of the lateral bore 8*a* as seen from the inner surface of the atomizer body 8 is larger than the projected shape of the cylindrical vibrator 4 as viewed from the inner surface of the atomizer body 8.

The projected shape of the lateral bore 8*a* as seen from the outer surface of the atomizer body 8 is round. The lateral bore 8*a* has a step portion in the back thereof. The cylindrical vibrator 4 is inserted into the atomizer body 8 through the lateral bore 8*a* and is fixed thereto.

It is necessary that the insertable cross-sectional area of the cylindrical vibrator 4 with respect to the lateral bore 8*a* be larger than that of the vibration-increasing block 5.

A space is left between the inner surface of the lateral bore 8*a* and the outer surface of the vibration-increasing block 5 after the cylindrical vibrator 4 has been inserted into the atomizer body 8 from the lateral bore 8*a* and is fixed to the atomizer body 8.

The space is occupied therein with a filler member 17 leaving a narrow clearance or gap 19 between the inner surface of the filler member 17 and the outer surface of the vibration-increasing block 5 so the vibration-increasing block 5 may be vibrated therein.

This narrow clearance or gap 19 is about 0.5 mm. The material used in the filler member 17 is selected from the group of an aluminum diecasting, a zinc diecasting, a synthetic resin member, and a rubber member etc.

Figure 2:
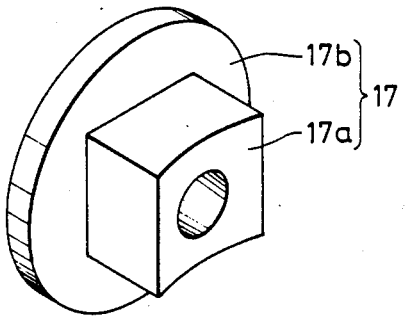
FIG. 2 shows one example of the filler member shown in FIG. 1.
Figure 3A:
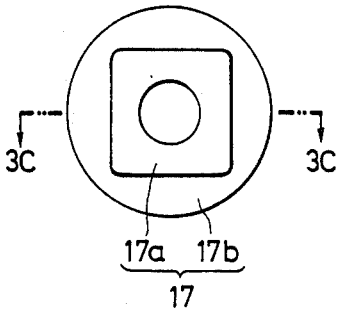
FIG. 3A is a front elevational view of the filler member shown in FIG. 2.
Figure 3B:
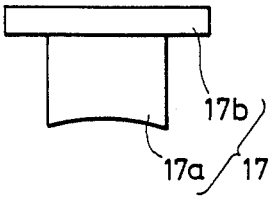
FIG. 3B is a side elevational view of the filler member shown in FIG. 2.
Figure 3C:
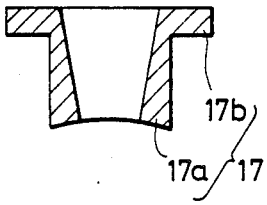
FIG. 3C is a sectional view of the filler member taken a line 3C—3C of FIG. 3A.

As shown in FIG. 2, the filler member 17 comprises a substantial square part 17*a* and a cylindrical part 17*b*. Each of the substantially square part 17*a* and the cylindrical part 17*b* of the filler member 17 has a continuous cylindrical hole in the central portion thereof, through which a cylindrical part of the vibration-increasing block 5 may be inserted.

The front shape of the substantially square part 17*a* of the filler member 17 is contoured along the inner surface of the atomizer body 8. The cylindrical part 17*b* of the filler member 17 is fitted with a step portion of the lateral bore 8*a* so as to fit within the atomizer body 8. The seal member 11 provides a seal against from the air outside and holds the filler member 17 in the bore.

As a result, the clearance between the inner surface of the lateral bore 8*a* and the outer surface of the vibration-increasing block 5 can be minimized with the installation of the filler member 17. The seal member 11 is attached to the portion of the atomizer body 8 which is provided with the lateral bore 8*a* so as to seal the clearance between the filler member 17 and the vibration-increasing block 5.

The body 1 of the fuel supply unit has a fuel nipple 12 and a fuel pressure regulator 13 on the side thereof. The fuel pressure regulator 13 has a return nipple 14. A suction pipe 15 couples the throttle body 10 with an engine 16.

To assemble the fuel atomizer 2, the seal member 11 and the filler member 17 are fitted around the vibration-increasing block 5, and the cylindrical vibrator 4 is then joined to the vibration-increasing block 5. The cylindrical vibrator 4 is thereafter inserted from the lateral bore 8*a* and is set properly therein. The filler member 17 and the seal member 11, which are formed separately in this embodiment, may be formed integrally.

In the above arrangement, air is introduced from the outer circumferential portion of a housing 7*a*, in which the injector 6 is housed. Fuel is supplied under pressure from a fuel tank into a fuel pump, and introduced from the fuel nipple 12 into the body 1 of the fuel supply unit, and then into the fuel pressure regulator 13 through the space around the injector 6.

The fuel pressure regulator 13 has the function of setting the pressure of the fuel at a constant level. A portion of the fuel supplied under pressure to the fuel pressure regulator 13 is returned to the fuel tank by way of the return nipple 14.

When the injector 6 is operated, fuel is discharged from the fuel discharge port 6*a*. The discharged fuel passes through the end opening 4*a* and strikes the inner surface of the ultrasonically-driven cylindrical vibrator 4 so as to be momentarily atomized. The atomized fuel is supplied with the air to engine 16 through the suction pipe 15.

In this embodiment, an empty space as in a conventional fuel supply apparatus having a fuel atomizer does not exist between the inner surface of the lateral bore 8*a* in the atomizer body 8 and the outer surface of the vibration-increasing block 5, and the lateral bore 8*a* is kept it air-tight by the seal member 11.

As a consequence, even when fuel discharged from the injector 6 is scattered, and even when the fuel is scattered due to pulsation and prefiring of suction air, fuel does not collected between the inner surface of the lateral bore 8*a* and the outer surface of the vibration-increasing block 5.

In the above embodiment of a fuel supply apparatus having a fuel atomizer according to the present invention, a space or clearance between the inner surface of the lateral bore 8*a* and the outer surface of the vibration-increasing block 5 is minimized by the installation of the filler member 17, so that there is no wide clearance as in a conventional fuel supply apparatus having a fuel atomizer.

As a result, fuel does not collect between the inner surface of the lateral bore 8*a* and the outer surface of the vibration-increasing block 5. Accordingly, fuel does not flow along the wall of the atomizer body 8, nor does fuel run into the engine 16.

The above structure improves atomization efficiency. Namely, the output level based on the atomization of fuel can be improved, and fuel consumption can be minimized. Moreover, the operational characteristics and various kinds of performance of the fuel supply apparatus having a fuel atomizer can be improved.

When the fuel atomizer 2 is out of order, the fuel atomizer 2 alone can be replaced.

Figure 4:
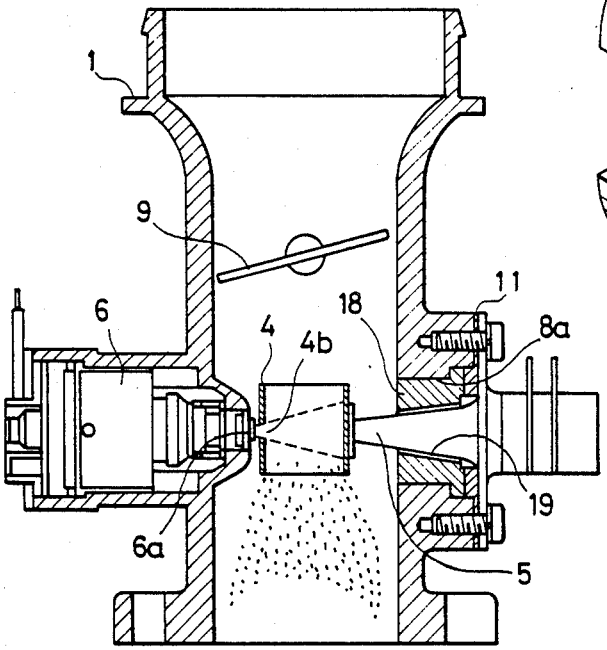
FIG. 4 is a longitudinal sectional view of another embodiment of the fuel supply apparatus having a fuel atomizer according to the present invention.

FIG. 4 shows another embodiment of the present invention. The embodiment shown in FIG. 4 is different from the above-described embodiment shown in FIG. 1 in the following respects. In the first embodiment, the fuel is supplied to a space on the upstream side of the throttle valve 9, and fuel discharge port 6*a* faces the end surface of an open end of the hollow, cylindrical vibrator 4.

In the second embodiment shown in FIG. 4, the fuel is supplied to a space on the downstream side of the throttle valve 9 and is fuel discharge port 6*a* is faces to a lateral bore or opening 4*b* in a side wall of the cylindrical vibrator 4 at right angles to the axis of the cylindrical vibrator 4.

In this second embodiment, fuel supplied from the discharge port 6*a* of the injector 6 impinges upon the inner surface of the cylindrical vibrator 4 through the lateral bore 4*b* formed in the wall thereof, to be atomized.

Figure 5:
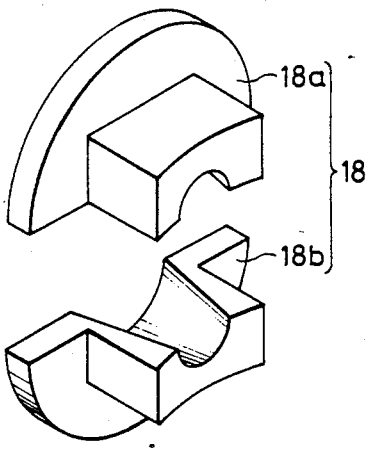
FIG. 5 shows another example of the filler member shown in FIG. 4.

FIG. 5 shows another example of a filler member 18, which is different from the filler member 17 in the embodiment of FIG. 1 in the following respect. The filler member 17 in the embodiment of FIG. 1 is integrally formed, while the filler member 18 shown in FIG. 4 is formed as two similar components 18*a* and 18*b*, as shown in FIG. 5.

If the lateral bore 8*a* is formed squarely with the filler member 18, which is to be fitted therein, formed substantially with a square shape and divided in two, the filler member 18 can be set in a predetermined direction.

As a result, two inner ends of two components 18*a* and 18*b* of the filler member 18 can be aligned respectively with the inner surface of the body 1 of a fuel supply unit, which is usually cylindrically formed.

Since the lateral bore 8*a* in the atomizer body 8 can be formed squarely in conformity with the front elevational the shape, i.e. square shape of the cylindrical vibrator 4, the lateral bore 8*a* can be maintained airtight easily by the seal member 11.

The embodiment shown in FIGS. 4 and 5 has the same operation and effects as the embodiment of FIG. 1.

I claim:

1. In a fuel supply apparatus for an internal combustion engine having a body through which a suction passage extends, an injector having a fuel discharge port disposed in said body, a lateral bore formed in a side wall portion of said body, a throttle valve disposed in said suction passage, and a fuel atomizer disposed adjacent to said fuel discharge port for atomizing fuel supplied therefrom, said atomizer including a cylindrical vibrator the axis of which extends towards said suction passage, said vibrator having an opening which faces said fuel discharge port, and a vibrator-increasing block extending through said lateral bore and having said cylindrical vibrator affixed to an end thereof, the cross-sectional area of said vibrator as projected onto said lateral bore being greater than the cross-sectional area of said vibration-increasing block as projected onto said lateral bore, and a space being provided between the surface of said lateral bore and the surface of said vibration-increasing block extending therethrough, the improvement comprising a filler member for filling a space disposed in the space between said lateral bore and said vibration-increasing block, an outer peripheral surface of said filler member formed in close contact with a peripheral surface of said lateral bore, and a narrow clearance formed between an inner peripheral surface of said filler member and an outer peripheral surface of said vibration-increasing block so as to substantially reduce the volume of said space while still permitting said vibration-increasing block to be vibrated therein.

2.The improvement according to claim 1, wherein said filler member is made of a plurality of similarly configured components assembled together in said lateral bore to form said filler member therein.

3. The improvement according to claim 1, wherein the cross-sectional shape of said lateral bore is substantially square and the cross-sectional shape of said filler member as inserted into said lateral bore is substantially square.

4. The improvement according to claim 3, wherein said filler member is made of a plurality of similarly configured components assembled together in said lateral bore to form said filler member therein.

5. The improvement according to claim 1, wherein a tip surface shape of said filler member is substantially the same as an inlet shape of said lateral bore, and the tip surface portion of said filler member is disposed along an inside surface of said body so as to smooth the air flow.

6. In a fuel supply apparatus for an internal combustion engine having a body through which a suction passage extends, an injector having a fuel discharge port disposed in said body, a lateral bore formed in a side wall portion of said body, a throttle valve disposed in said suction passage, and a fuel atomizer disposed adjacent to said fuel discharge port for atomizing fuel supplied therefrom, said atomizer including a cylindrical vibrator the axis of which extends towards said suction passage, said vibrator having an opening which faces said fuel discharge port, and a vibration-increasing block extending through said lateral bore and having said cylindrical vibrator affixed to an end thereof, the cross-sectional area of said vibrator as projected onto said lateral bore being greater than the cross-sectional area of said vibration-increasing block as projected onto said lateral bore, and a space being provided between the surface of said lateral bore and the surface of said vibration-increasing block extending therethrough, the improvement comprising a filler member disposed in the space between the lateral bore and said vibration-increasing block so as to substantially reduce the volume of said space while still permitting said vibration-increasing block to be vibrated therein, and wherein said lateral bore has a first portion the cross-sectional shape of which is substantially square and a second portion the cross-sectional shape of which is round, and said filler member has a first portion the cross-sectional shape of which is substantially square and a second portion the cross-sectional shape of which is round so as to effectively fit the shape of said lateral bore.

7. The improvement according to claim 6, wherein said filler member is made of a plurality of similarly configured components assembled together in said lateral bore to form said filler member therein.

8. The improvement according to claim 1, wherein said discharge port is disposed on a downstream side of said throttle valve.

9. The improvement according to claim 8, wherein said fuel discharge port extends substantially at a right angle to a longitudinal center axis of the cylindrical vibrator.

* * * * *